US005964668A

United States Patent [19]

Tai et al.

[11] Patent Number: 5,964,668

[45] Date of Patent: Oct. 12, 1999

[54] LASER DOTS PUTTING AID

[75] Inventors: Anthony M. Tai, Northville; Eric J. Sieczka, Saline, both of Mich.

[73] Assignee: EOTech, Inc., Ann Arbor, Mich.

[21] Appl. No.: 09/026,068

[22] Filed: Feb. 19, 1998

[51] Int. Cl.[6] ..... A63B 69/36

[52] U.S. Cl. ..... 473/220; 473/409; 362/259

[58] Field of Search ..... 473/220, 241; 362/259

[56] References Cited

U.S. PATENT DOCUMENTS

| | | | |
|---|---|---|---|
| 3,070,373 | 12/1962 | Mathews et al. . | |
| 3,953,034 | 4/1976 | Nelson . | |
| 5,169,150 | 12/1992 | Tindale . | |
| 5,174,572 | 12/1992 | Ho | 473/241 |
| 5,193,812 | 3/1993 | Hendricksen . | |
| 5,207,429 | 5/1993 | Walmsley et al. | 473/220 |
| 5,213,331 | 5/1993 | Avanzini . | |
| 5,465,972 | 11/1995 | Cornett . | |
| 5,611,739 | 3/1997 | Carney . | |
| 5,692,965 | 12/1997 | Nighan et al. | 473/220 |

OTHER PUBLICATIONS

Advertisement, "You Can Putt Like The Pros In Just 5 Minutes Per Day–", obtained at PGA Merchandise Show on Jan. 23, 1998.

Advertisement, "Short Game Products", obtained at PGA Merchandise Show on Jan. 23, 1998.

*Primary Examiner*—George J. Marlo

*Attorney, Agent, or Firm*—Brooks & Kushman P.C.

[57] ABSTRACT

A putting aid includes a clamp for mounting the putting aid on the shaft of a putter and a dotted line projector mounted on the clamp for adjustment relative to the contact surface of the putter so that the dotted line is projected perpendicular to the contact surface. The dotted line projector includes a bright light source, such as a laser diode, a power source and the necessary optical elements to generate and project a line of dots on the putting surface extending generally perpendicular to the putter clubface. In one embodiment, the dots are equally spaced apart so that the distance of the backswing can be gauged by observing the number of dots that pass over the surface of the ball during the backswing. In one embodiment the putting aid includes a mounting ball secured to the clamp, and the housing further includes a housing clamp adapted to be releasably secured on the mounting ball to allow simultaneous positioning of the projector about two or more axes.

10 Claims, 4 Drawing Sheets

Figure 5(a)
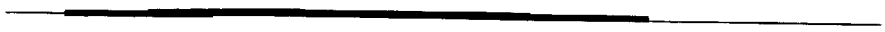
Figure 5(b)
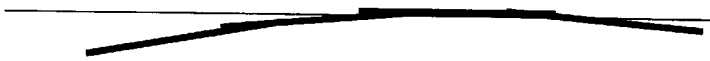
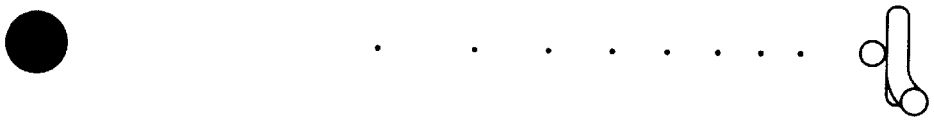
Figure 6(a)
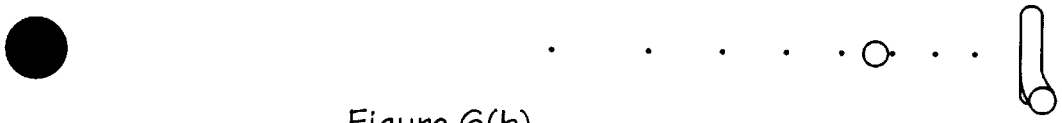
Figure 6(b)

LASER DOTS PUTTING AID

TECHNICAL FIELD

This invention relates to portable laser-powered putting stroke alignment aids.

BACKGROUND ART

To putt accurately, the putter head must be aligned correctly, with the putting stroke preferably following a straight line path on the backstroke, as well as on the forward stroke up to and through the point of contact with the ball. And, since speed and distance are important considerations, it is useful to be able to accurately correlate the speed and distance of the putted ball with the length of the backstroke.

Many existing putting aids employ mechanical guiding devices or targets to provide feedback about the user's putting stroke. However, these devices cannot be easily moved to putt from different locations during practice.

U.S. Pat. No. 5,465,972, issued to Cornett, describes a laser sighting unit which directs a laser beam to a point, such as at the hole, to aid the golfer in aligning the golf club head angle. However, the laser dot is very difficult to see, particularly in bright daylight, if the hole is more than ten feet away, and the mounting bracket requires many adjustments to properly align the beam. Moreover, this device only provides an indication of putter head alignment.

U.S. Pat. No. 5,207,429, issued to Walmsley et. al., describes a putting aid including a planar light beam source which projects a line of light on the ground. While this aid may provide an indication of putter head alignment, the light energy emitted from a laser diode in the form of a line of any practical length is of limited intensity, and is, again, often difficult to see in bright daylight.

Other putting aids, such as are disclosed in U.S. Pat. Nos. 5,611,739, issued to Carney, and 5,193,812, issued to Hendricksen, include means for projecting a light beam or dot to a target or along the ground as p art of a structure that is integral with or permanently mounted directly on the club head. These devices have the same limitations as the two above-mentioned devices. Also, they often affect the putting stroke itself, due to the location (close to the putter club head) and weight of the devices.

DISCLOSURE OF THE INVENTION

It is therefore one object of the present invention to provide a putting aid which is light, compact, easy to install, and easy to adjust on the user's putter.

It is another object of the present invention to provide a putting aid which has minimal affect on the stroke of the putter upon which it is installed.

It is yet another object of the present invention to provide a laser putting aid which provides a bright indicator of the linear path from the putter head toward the target.

It is yet another object of the present invention to provide a laser putting aid which provides a series of dots along the linear path of the putting stroke as indicator marks so as to allow the user to gauge the length of the backstroke.

In carrying out the above and other objects of the invention, the laser dots putting aid of the present invention includes a projector including a bright light source such as a laser diode and the optical elements for generating a light pattern comprising a plurality of dots defining a linear path, a clamp for releasably mounting the aid on the shaft of a putter, and an adjustable mount by which the light projector is attached to the clamp and may be oriented with a single adjustment to align the dotted line to be perpendicular to the contact point on the putter clubhead face.

The optical elements of the dotted line projector also preferably project the dots such that each dot is equally spaced at a preselected distance d from each adjacent dot.

The adjustable mount by which the light projector is attached to the clamp preferably includes a mounting ball which is releasably clamped to the projector, such that the projector may be positioned by moving the projector on the surface of the mounting ball, then tightening the clamp around the mounting ball to secure the projector in place.

Thus, when installed on the shaft of a putter and properly aligned, the laser dots putting aid projects a series of bright dots along a linear path perpendicular to the clubface, intersecting the center of the clubface, and projecting toward the intended path of the ball. The straightness of the putting stroke can therefore be quickly determined by observing the movement of the dotted line from the backswing, through contact with the ball and completion of the follow through of the stroke. If the dots forming the linear path appear to move along that path during the putting stroke, the stroke is straight. If the moving dotted line forms an arc or otherwise veers off of the linear path during the stroke, the user receives immediate feedback of this variation in the stroke.

Moreover, where the dots are equally spaced, the length of the backswing can be gauged by counting the number of dots that pass through the ball during the backswing, thereby training the user to (1) putt with a consistent backswing length, and (2) gauge the affect of varying the length of the backswing on the speed and distance of the putted ball.

These and other objects, features, and advantages of the present invention are readily apparent from the following detailed description of the best mode for carrying out the invention when taken in connection with the accompanying drawings.

BRIEF DESCRIPTION OF THE DRAWINGS

FIG. 5(*a*) is an illustration of the stroke paths viewed by the user during a linear putting stroke;

FIG. 5(*b*) is an illustration of the stroke path observed by the user during an arcuate putting stroke; and FIGS. 6(*a*) and 6(*b*) illustrate how the projection of the dotted line stroke path can be used to gauge backswing distance.

BEST MODE FOR CARRYING OUT THE INVENTION

Figure 1:
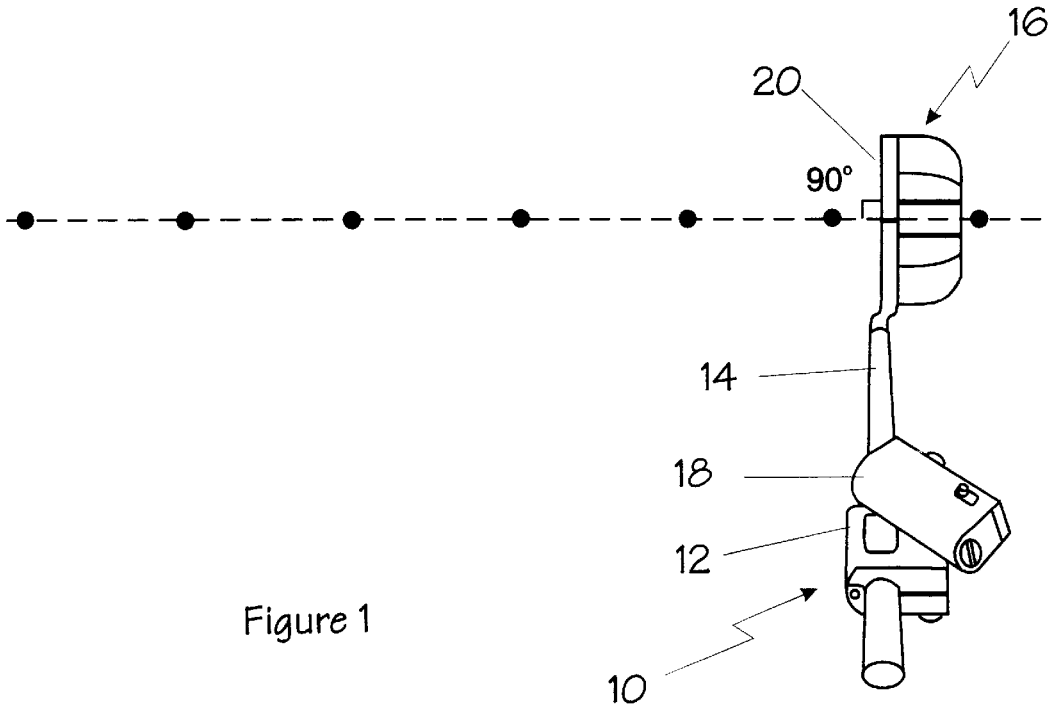
FIG. 1 is an overhead perspective view of the laser dots putting aid of the present invention installed on a putter.

Referring to FIG. 1, the laser dots putting aid, generally indicated as 10, includes a clamp 12 for mounting the putting aid on the shaft 14 of a putter 16, and a dotted line projector 18 mounted on the clamp 12 for adjustment relative to the contact surface 20 of the putter 16 so that the dotted line is projected perpendicular to the contact surface.

Figure 2:
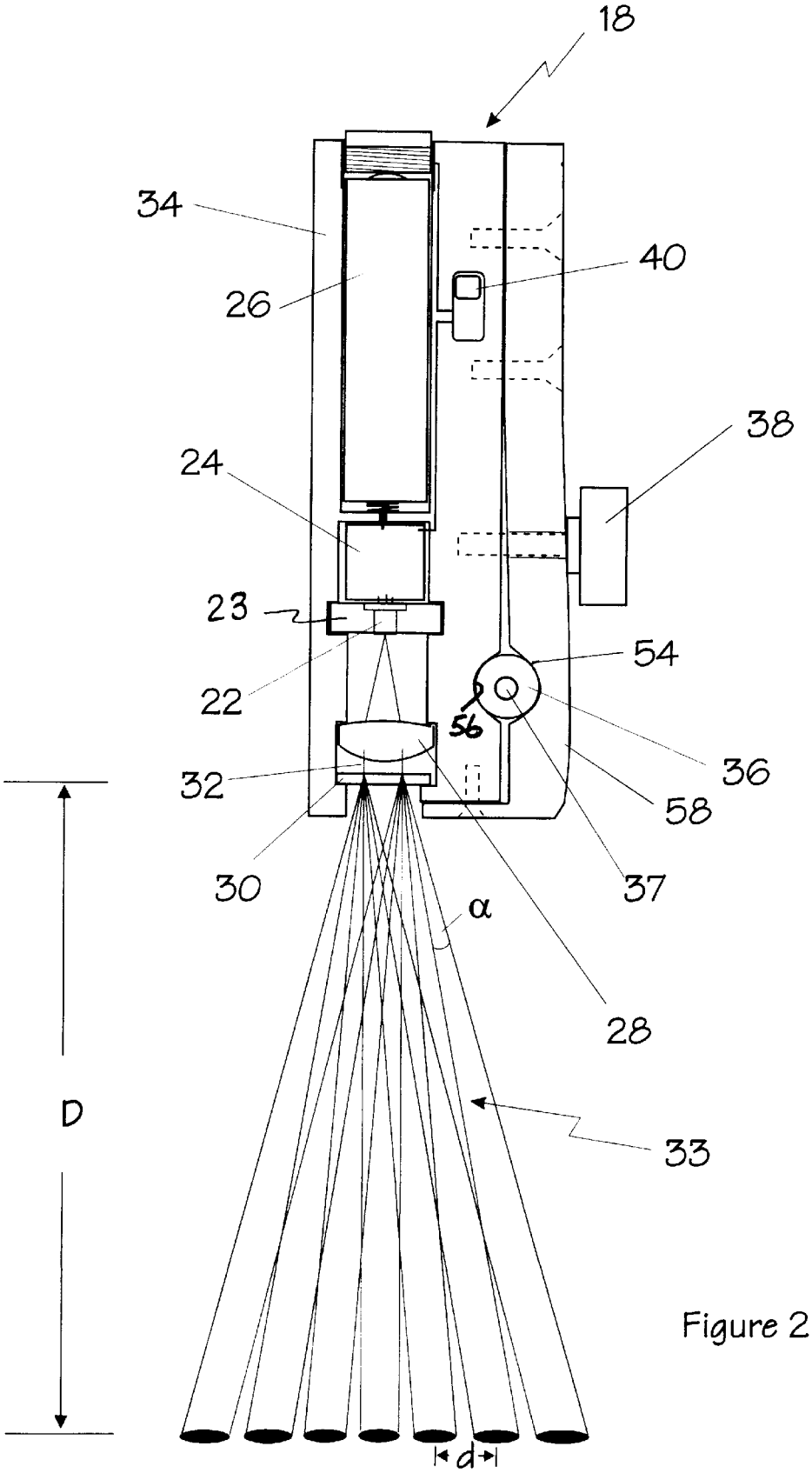
FIG. 2 is a top cross-sectional view of the dotted line projector.

As shown in FIG. 2, the dotted line projector 18 includes a bright light source 22, such as a laser diode, driving electronics 24, a power source 26, such as a battery, and the necessary optical elements to generate and project the desired dotted line.

In the illustrated embodiment, these optical elements include a collimator 28, such as an ashperic lens, for collimating the laser beam, and a beam splitter 30, preferably in the form of a holographic optical element, which converts the single collimated beam 32 into n planar collimated beams 33, with each beam being projected from the beam splitter 30 at a preselected angle from adjacent beams to project a line of dots on the putting surface.

In one embodiment, the n beams are all projected at the same angle with respect to adjacent beams to create a preselected distance d between the dots when the beams are projected onto the putting surface from an expected distance D above the putting surface.

In one embodiment, an aspheric lens available from Thor Labs of Newton, New Jersey, is utilized to collimate the beam.

In one embodiment, the beam splitter 30 is designed to diffract the incoming collimated beam into seven equally bright beams spaced 5 degrees apart. When mounted approximately 50 cm from the putter clubhead, this arrangement produces seven dots along a straight line about 4.4 cm apart.

The above-described components of the projector 18 are all preferably mounted within a housing 34. The housing may include a switch for connecting and disconnecting power to the laser diode, and releasable battery cap for releasably securing the battery within the housing.

The laser diode 22 may be any commercially available laser diode that produces a beam of intensity suitable to project the dotted line pattern that is discernable on the putting surface in normal (i.e. relatively bright) light conditions experienced when golfing. In one embodiment, the laser diode is Model No. HL6312, available from Hitachi Corporation of Japan, which emits a beam of about 635 nm (or shorter) wavelength with about 5 mW optical power. Of course, other light beam generators may also be utilized, provided that they are suitably lightweight, inexpensive, compact, and sufficiently powerful to generate a relatively bright, narrow beam of light.

A suitable heat sink 23 is also preferably provided to dissipate the heat from the light source 22.

The beam splitter 30 is preferably a holographic optical element which is fabricated by a molding technique on optical plastic material, such as acrylic, using known fabricating methods. It is designed using a known iterative algorithm. Since there is a Fourier transform relationship between the hologram phase function and the diffracted output pattern, the algorithm iterates between the hologram phase function and the output pattern, each time constraining the output intensity to the desired output pattern and the hologram phase function to unit magnitude and a finite number of quantitized phases. One type of holographic beam splitter 30 which performs this beam diffraction is Model No. N1007, available from Mems Optical, Inc. of Huntsville, Ala.

The driving electronics 24 may be any commercially available or custom built driving circuit suitable for driving the chosen laser diode at the constant power desired.

The power source 26 is typically a battery of any type that is suitable to power the chosen laser diode. A Type 123A Lithium battery is used in the illustrated embodiment, and provides at least 10 hours of power.

Figure 3:
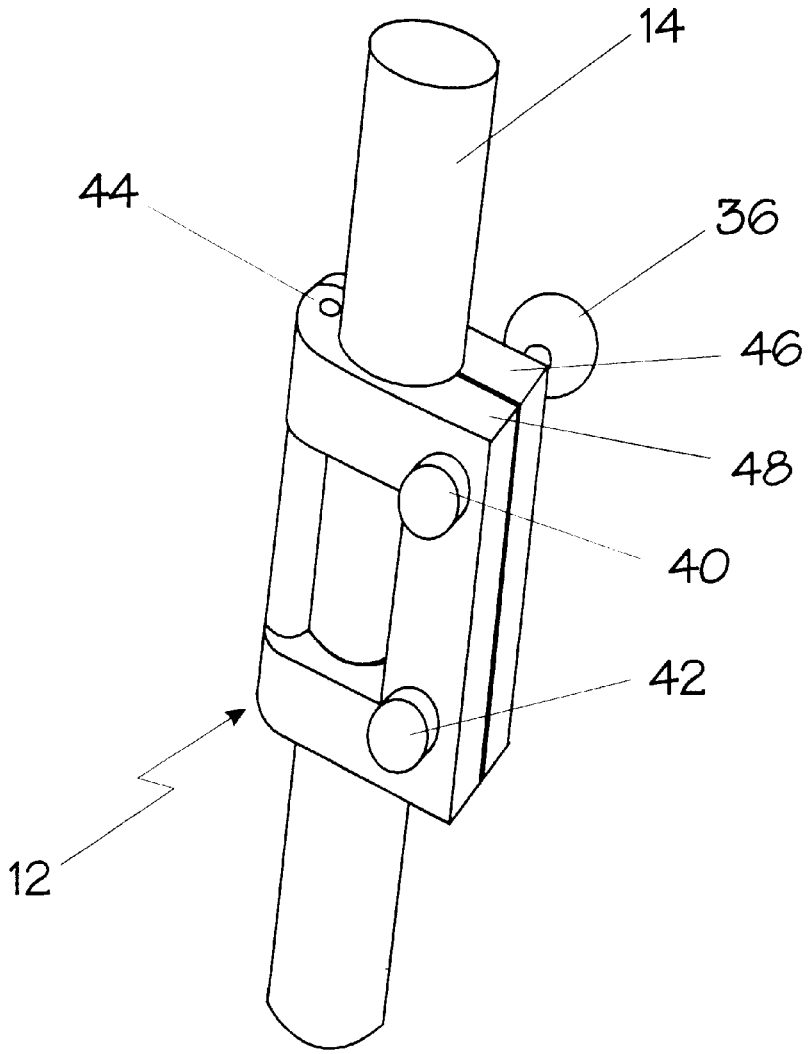
FIG. 3 is a perspective view of the clamp and mounting ball.
Figure 4:
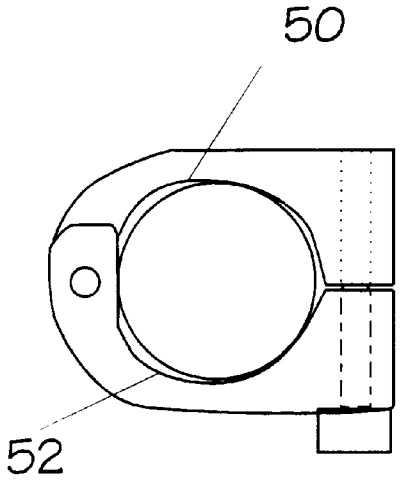
FIG. 4 is a path cross-sectional view of the clamp mounted on a putter shaft.

Referring to FIGS. 3 and 4, the dotted line projector 18 (not shown) is mounted on a mounting ball 36 which, in turn, is mounted on or integrally formed as part of the clamp 12.

Referring again to FIG. 2, the laser projector 18 is clamped onto the mounting ball 36 so that it can be rotated about the mounting ball in any direction. Locking screw 38 may be adjusted to loosen the clamp faces 54 and 56, located on the projector housing 34 and housing clamp 58, respectively, to allow for positioning of the beam. The screw 38 is then tightened, thereby tightening the clamping surfaces 54 and 56 around the mounting ball. As previously described, the mounting ball may be made out of a suitable metal, such as stainless steel, or, alternatively, made out of a hard plastic or other suitable composite material. The surfaces of the clamp faces are generally contoured to form a generally spherical pocket which surrounds and contacts the mounting ball 36. With this arrangement, the projector can be quickly rotated about two or more axes simultaneously by merely loosening the locking screw 38, positioning the projected dot pattern, and then tightening the locking screw.

In the illustrated embodiment, the clamp 12 includes two opposed generally rectangular members 46 and 48 which are pivotally attached to each other, such as by a hinge pin 44. The hinge members each include generally cylindrical contact faces 50 and 52. When the hinge members are closed and tightened around a putter shaft 14, such as by conventional tightening screws 40 and 42, the hinge, and thereby, the attached projector are securely mounted to the putter.

As seen in cross-section in FIG. 4, the contact surfaces 50, 52 of the hinge members 46, 48 are preferably shaped to provide three points of contact with the putter shaft. The three contact points on the contact faces 50, 52 allow the clamp to grip circular shafts of varying diameters securely and without wobbling. The putting aid 10 is attached to the shaft 14 just below the grip by tightening one or more (preferably two) tightening screws 40, 42 to secure the clamp in place. The clamp is preferably made of plastic, such as nylon, so that it will not scratch or otherwise mar the putter shaft.

The components other than the laser diode, the battery, the driving electronics, and the optical elements, may all be fabricated from suitable resilient plastic material utilizing conventional molding methods. It will be appreciated that other similarly suited materials, such as extruded or stamped metals, may be employed for one or more of the components of the present invention.

In operation, the laser dot putting aid is mounted on the shaft of the putter just below the grip by suitably tightening the clamp 12. The dotted line projector 18 is then adjusted to project the dotted line beam to be perpendicular to and cutting across the center of the putter club face as shown in FIG. 1. Since the putter head is oriented such that the club face 20 is perpendicular to the intended path of the ball, the dotted line beam indicates proper alignment when the dotted line is pointed towards the desired location.

As shown in FIGS. 5(*a*) and 5(*b*), the path of the stroke can be determined by observing the movement of the dots from the backswing through completion of the follow through. The dots will appear to travel in a continuous line during the putting stroke if the stroke is straight. If the stroke is not straight, the moving dotted line will form an arc or jog about another non-linear path during the stroke.

As illustrated in FIGS. 6(*a*) and 6(*b*), the distance of the backswing and, thus, the distance of the putt, can be gauged by counting the number of laser dots that pass over the surface of the ball during the backswing. This allows the user to obtain a consistent backswing, as well as calibrate the speed of the green during practice.

The brightness of the dotted line image is proportional to $1/D^2$ where D is the distance from the dot to the eye. A single dot projected to a target is, therefore, difficult to see if the target is more than about ten feet away. In contrast, the present invention projects a series of dots relatively closer to the golfer (at his feet). These dots are discernable, even in bright light, and project a line coincident with the path of the ball when the ball is contacted by the putter face.

The intensity of the dotted line is of a magnitude higher than a continuous line generated with the same power light source because all the laser energy is concentrated on the dots. For example, with a device that projects seven 1 mm diameter dots onto the ground with 100 mm dot spacing, the dots effectively form a line about 700 mm long. Comparing this dotted line with a continuous line 1 mm wide and 700 mm long projected by a laser with the same output power, the intensity of the dots is about 200 times brighter than the continuous line. Moreover, as previously described, the use of the dots provides a quantitative indicator of backswing length which is not provided by a continuous line.

While the best mode for carrying out the invention has been described in detail, those familiar with the art to which this invention relates will recognize various other alternative designs and embodiments for practicing the invention as disclosed by the following claims.

What is claimed is:

1. A putting aid comprising:

a dotted line projector including a housing, and a light source, a collimator, and a beam splitter mounted within the housing, wherein the collimator projects a collimated beam from the light source to the beam splitter, and the beam splitter splits the collimated beam into a selected number of linearly spaced apart beams;

a power source; and a clamp for releasably mounting the housing on the shaft of a putter so as to allow for positioning of the beams to project a plurality of dots defining a linear path extending perpendicular to the clubface of the putter.

2. The putting aid of claim 1 further including a mounting ball secured to the clamp, and wherein the housing includes a housing clamp adapted to be releasably secured on the mounting ball to allow simultaneous positioning of the projector about two or more axes.

3. The putting aid of claim 1 wherein the beam splitter defracts the collimated beam into a preselected number of n beams to create a preselected distance, d, between the dots when the beams are projected onto a putting surface from a preselected distance, D, above the putting surface.

4. The putting aid of claim 3 wherein the beam splitter diffracts each of the collimated beams at an angle of about 5 degrees with respect to adjacent beams.

5. The putting aid of claim 4 wherein the beam splitter is designed to diffract the collimated beam into seven beams which project seven dots spaced about 4.4 centimeters apart along a straight line when the projector is mounted approximately 50 centimeters from the putting surface.

6. The putting aid of claim 1 wherein the light source is a laser diode.

7. The putting aid of claim 1 wherein the collimator is an aspheric lens.

8. The putting aid of claim 1 wherein the beam splitter is a holographic optical element.

9. A putting aid comprising:

a projector including a light source and the optical elements for generating a light pattern defining a linear path on a putting surface;

a power source connected to the light source;

a housing in which the projector and the power source are mounted;

a putter clamp for releasably mounting the housing on the shaft of a putter, the putter clamp including a mounting ball secured thereon; and a housing clamp secured to the housing and adapted to be releasably secured on the mounting ball so as to allow for positioning of the projector to project the linear path extending generally perpendicular to the putter clubface.

10. A putting aid comprising:

a dotted line projector including a housing having mounted therein, a power source, a laser diode light source switchably connected to the power source, an aspheric collimating lens, and a beam splitter, wherein the collimating lens projects a collimated beam from the light source to the beam splitter, and the beam splitter splits the collimated beam into a preselected number of n beams which project n dots spaced apart in a linear path a preselected distance, d, when the beams are projected onto a putting surface from a preselected distance, D, above the putting surface;

a clamp for releasably mounting the housing on the shaft of a putter;

a mounting ball secured to the clamp; and a housing clamp secured to the housing and adapted to be releasably secured on the mounting ball to allow simultaneous positioning of the projector about two or more axes so as to allow for positioning of the beams to project the linear path perpendicular to the clubface of the putter.

* * * * *